United States Patent [19]

Kusayama

[11] Patent Number: 4,782,563

[45] Date of Patent: Nov. 8, 1988

[54] END STOP FOR SLIDE FASTENERS

[75] Inventor: Masahiro Kusayama, Kurobe, Japan

[73] Assignee: Yoshida Kogyo K. K., Tokyo, Japan

[21] Appl. No.: 153,571

[22] Filed: Feb. 1, 1988

Related U.S. Application Data

[63] Continuation of Ser. No. 046,578, May 6, 1987, abandoned.

[30] Foreign Application Priority Data

May 6, 1986 [JP] Japan ..... 61-68060[U]

[51] Int. Cl.[4] ..... A44B 19/36

[52] U.S. Cl. ..... 24/435; 24/389; 24/436

[58] Field of Search ..... 24/435, 388, 389, 436, 24/433

[56] References Cited

U.S. PATENT DOCUMENTS

| | | | |
|---|---|---|---|
| 2,191,280 | 2/1940 | Kiessling | 24/435 |
| 2,532,724 | 12/1950 | Krupp | 24/389 |
| 2,928,156 | 3/1960 | Doelter et al. | 24/388 |
| 3,005,247 | 10/1961 | Doelter | 24/389 |
| 3,353,233 | 11/1967 | Frohlich | 24/436 |
| 3,864,792 | 2/1975 | Takahashi et al. . | |
| 3,869,765 | 3/1975 | Fukuroi . | |
| 3,869,765 | 3/1975 | Fukuroi | 24/435 |
| 3,895,418 | 7/1975 | Ebata . | |
| 3,906,594 | 9/1975 | Takahashi et al. | 24/436 |
| 3,959,858 | 6/1976 | Fukuroi . | |
| 4,112,553 | 9/1978 | Weitzner | 24/433 X |
| 4,488,338 | 12/1984 | Takahashi . | |
| 4,513,482 | 4/1985 | Fukuroi . | |
| 4,524,493 | 6/1985 | Inamura . | |
| 4,658,480 | 4/1987 | Morioka et al. . | |

FOREIGN PATENT DOCUMENTS

| | | |
|---|---|---|
| 48-37421 | 11/1973 | Japan . |
| 49-36975 | 10/1974 | Japan . |
| 58-181210 | 12/1983 | Japan . |
| 58-181211 | 12/1983 | Japan . |
| 59-93208 | 6/1984 | Japan . |
| 59-93209 | 6/1984 | Japan . |
| 59-25223 | 7/1984 | Japan . |
| 59-41693 | 12/1984 | Japan . |
| 59-51805 | 12/1984 | Japan . |

*Primary Examiner*—Kenneth J. Dorner
*Assistant Examiner*—James R. Brittain
*Attorney, Agent, or Firm*—Hill, Van Santen, Steadman & Simpson

[57] ABSTRACT

An end stop for slide fasteners includes a rectangular block molded on a portion of folded inner longitudinal tape edges including a plurality of coupling elements mounted thereon, and an integral peripheral seat attached to opposed stringer tapes. The block has an end wall engageable with the slider, and a recess extending in the end wall and defined by and between the block and a portion of the peripheral seat. The portion of the peripheral seat terminates slightly short of the end wall of the block with the result that the slider is brought into abutment with the block without interference with the peripheral seat. The recess serves to absorb shock force which would otherwise be transmitted directly to the peripheral seat when the slider impinges on the block.

5 Claims, 3 Drawing Sheets

END STOP FOR SLIDE FASTENERS

This is a continuation, of application Ser. No. 046,578, filed May 6, 1987, abandoned.

BACKGROUND OF THE INVENTION

1. Field of the Invention

This invention relates generally to slide fasteners and more particularly to end stop devices therefor.

2. Description of the Prior Art

The slide fastener is provided with a slider reciprocally movable for opening and closing the same, the reciprocal movement of the slider being limited by stop members mounted on the top and bottom ends of the fastener.

There has been proposed a variety of fastener end stops, some being made of metals and others of plastics. Those made of thermoplastic materials to which the invention pertains are typically disclosed for example in Japanese Patent Publication Nos. 48-37421 and 49-36975, in which a piece of thermoplastic film or monofilament is attached by welding thermally or ultrasonically to an inner edge of a slide fastener tape, so that the film, fastener elements and tape yarns are integrally joined together. In the case of slide fasteners with support tapes coated with rubber or other impermeable materials to render the fastener gastight or waterproof, it has been difficult to attach the end stops securely to such tape surfaces against displacement under the influence of severe impinging pressure exerted by the slider where such pressure is greater than with ordinary slide fasteners.

Many attempts have been made to contrive means for anchoring the end stops on fluid-tight slide fasteners against displacement or detachment from the fastener tapes in use. One such atempt was to provide an end stop structure with a peripheral protuberance or fin which because of its flexibility serves to reinforce the positional stability of the end step by damping the impact pressure of the slider, in which instance it was necessary to remove the fin from the front end portion of the end step to avoid jamming with the slider. Tests were made on a number of samples of such end stops that were repeatedly struck by the slider, with the results that most of them became separated from the fastener progressively from where the slider pressure is directed.

SUMMARY OF THE INVENTION

With the foregoing drawbacks in view, the present invention seeks to provide a slide fastener having an end sop which is securelly held in place so as to withstand pressures or impinging contact with a slider without adversely affecting reciprocal movement of the latter.

According to the present invention, there is provided a slide fastener including an end stop which comprises a substantially rectangular block attached to a portion of folded inner longitudinal tape edges including a plurality of coupling elements mounted thereon, and a peripheral seat integral with the block and attached to opposed stringer tapes. The block has an end wall engageable with a slider and a recess extending in the end wall, the recess being defined by and between the block and a part of the peripheral seat. The portion of the peripheral seat terminates slightly short of the end wall. With this construction, the peripheral seat is held out of engagement with the slider and hence the slider can smoothly be brought into abutment with the block. The recess serves to absorb shock force or pressure transmitted to the peripheral seat when the slider impinges on the block of the end stop.

This and other objects and features of the invention will become manifest from the following detailed description taken in conjunction with the accompanying drawings which illustrate by way of example certain preferred embodiments of the invention and in which like reference numerals refer to like and corresponding parts throughouts the several views.

DETAILED DESCRIPTION OF THE PREFERRED EMBODIMENTS

Figure 1:
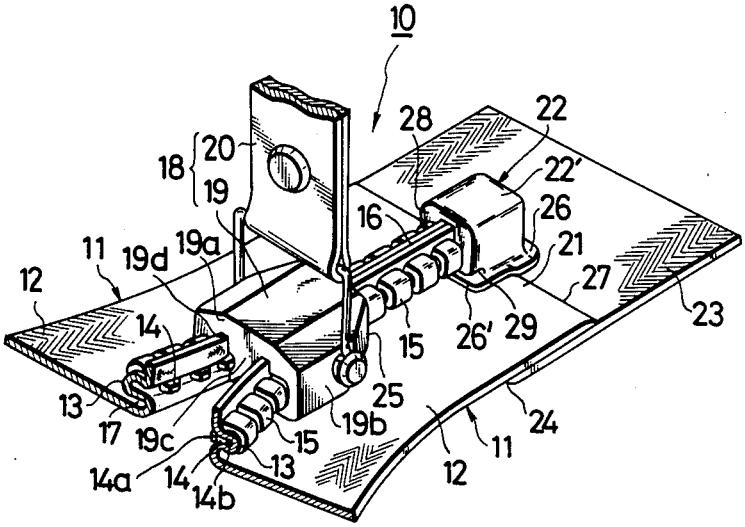
FIG. 1 is a perspective view of a portion of a slide fastener to which a bottom end stop is applied.

Referring now to the drawings and firstly to FIG. 1, there is shown a portion of a slide fastener 10 which is suitable for fluid-tight applications. The fastener 10 has a pair of stringers 11 each comprising a support tape 12 carrying on and along its inner longitudinal edge 13 a row of coupling elements 14 which is illustrated in the present embodiment to be of a discrete formation. Each individual element 14 has a coupling head portion **14*a* engageable with the corresponding coupling head portion 14*a* on the mating or opposite tape 12 and a heel portion 14*b* disposed remote from the coupling head portion 14*a* and covered by a sealing clamp 15. The tape edge 13 to which the row of coupling elements 14 is secured is folded to provide a sealing abutment 16 jointly with the opposite tape edge 13 to establish a seal against leakage in a manner well known in the art. As is also known, the tape edges 13 are raised with the coupling elements 14 above the surface of the web of the tape 12 to provide a clearance 17 for the passage of a slider 18**.

The slider 18 is conventional in that it has a slider body 19 and a pull tab 20 with which to manipulate the slider 18.

Figure 4:
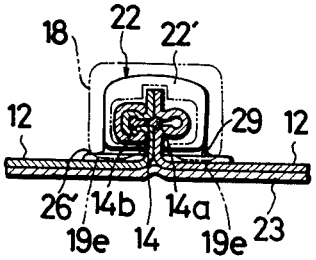
FIG. 4 is a cross-sectional view taken along line IV—IV of FIG. 3.
Figure 5:
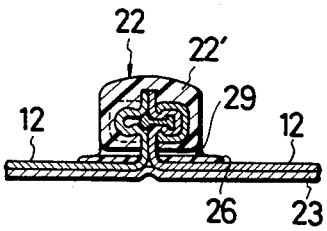
FIG. 5 is a cross-sectional view taken along line V—V of FIG. 3.

The slider body 19 includes an upper plate **19*a*, a pair of side walls 19*b* extending along opposite longitudinal edges of the upper plate 19*a*, and a partition wall 19*c* disposed centrally between the side walls 19*b* and depending from the upper plate 19*a*, there being defined in the slider body 19 a generally Y-shaped guide channel 19*d* for the passage therethrough of the opposed rows of coupling elements 14 to come int or out of engagement with each other. The side walls 19*b* have respective flanges 19*e*, 19*e* (FIG. 4) extending toward each other and receivable in the clearances 17, respectively. The movement of the slider 18 is limited or stopped at the bottom end 21 of the stringer 11 by a bottom end stop 22** which may be applied for example by injection molding.

There is provided a backing 23 which is partly connected and adhered to the lower surface of the bottom end portion 21 of the support tape 12 to reinforce the latter. The portion of the backing 23 which is thus joined to the support tape 12 extends toward and terminates at a point 24 which substantially registers with the rearward end 25 of the slider 18 when the latter is brought fully back in abutting engagement with the bottom end stop 22 as better shown in FIG. 3.

Figure 3:
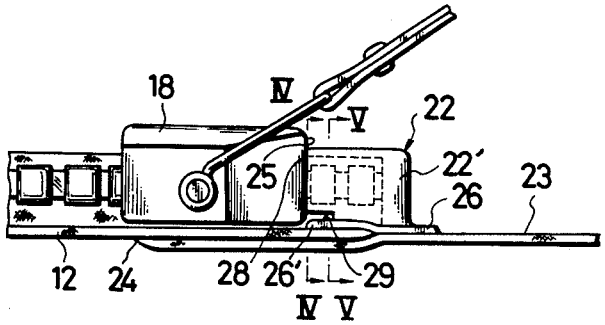
FIG. 3 is a side elevational view of the slide fastener of FIG. 1.

The bottom end stop 22, which constitutes an important aspect of the invention, is substantially in the form of a rectangular block 22' which is made preferably of a thermoplastic resin for its feasibility of being molded into a desired shape and for its flexibility of yielding to pressures exerted by the slider 18. The end stop 22 has a bottom peripheral portion flattened out to provide a thin flared seat or fin 26 which is effectively anchored adhesively or fusibly partly to the bottom end 21 of the tape 12 and partly to the reinforcing backing 23 across a marginal end extremity 27 of the tape 12 as shown in FIGS. 1 and 3. The end extremity 27 is rounded off to facilitate the attachment of the end stop 22 and to minimize friction with ambient objects. The end stop 22 has a front vertical end wall 28 with which the slider 18 is brought in abutting engagement as shown in FIG. 3. There is provided a cut-out recess or cave 29 extending in the front end wall 28 and formed between the flared seat 26 and the bottom wall of the block 22' adjoining the front end wall 28. The front end 26' of the seat 26 terminates barely short of the front vertical end wall 28 f the end stop 22 to avoid direct contact with the slider 18, as better shown again in FIG. 3, the end stop block 22' contains or has embedded therein a portion of interengaged folded edges 13 of the tape 12 incluling a plarality of coupling elements 14 and is thus attached adhesively, ultrasonically or by injection-molding to provide firm anchoring of the end stop 22 with respect to the support tape 12 against severe thrusting force of the slider 18.

Figure 2:
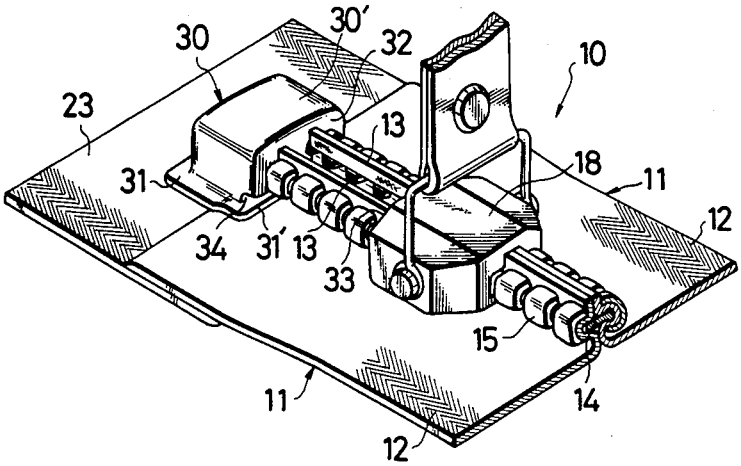
FIG. 2 is a perspective view a portion of a similar slide fastener to which a top end stop is applied.

FIG. 2 shows a top end stop 30 which is larger in width but otherwise the same in construction as the bottom end stop 22 above described. The top end stop 30 includes a substantially rectangular block 30' joined with an upper portion of the folded inner longitudinal edges 13 including a plurality of coupling elements 14 and the sealing clamps 15 associated therewith, and a thin seat 31 integral with the block 30' and attached to the webs of the respective tapes 12, 12. The block 30' has a vertical end wall 32 engageable with the forward end 33 of the slider 18, and a cut-out recess 34 extending in the end wall 32 and defined between the botton wall of the block 30' and the thin seat 31. The thin seat 31 projecting outwardly from the bottom of the body 30' excepting that the rear end 31' of the seat 31 terminates slightly short of the end wall 32 of the block 30' In the upper portion, the folded tape edges 13, 13 are parallel spaced from one another.

Figure 6:
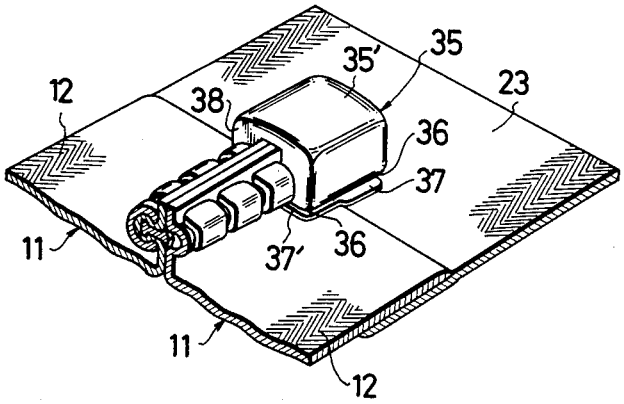
FIG. 6 is a perspective view of a portion of a slide fastener having a modified form of bottom end stop.

FIG. 6 shows a modified form of bottom end stop 35 which is substantially identical with the bottom end stop 22 of FIG. 1 except there is provided a cut-out recess or cave 36 in and around the entire bottom periphery of a substantially rectangular body 35' whereby the end stop 35 is rendered more flexible as a whole and attractive in appearance as a product. In the embodiment, a seat 37 of the end stop 35 also have a front end 37' terminating short of a front end wall 38 of the end stop block 35'.

Many changes and modification may be made in the specific form and construction herein above advanced, without departing from the scope of the appended claims. For example, it will be obvious to one skilled in the art to apply the principles of the invention to other different types of slide fasteners such as what is known as concealed slide fasteners.

Figure 7:
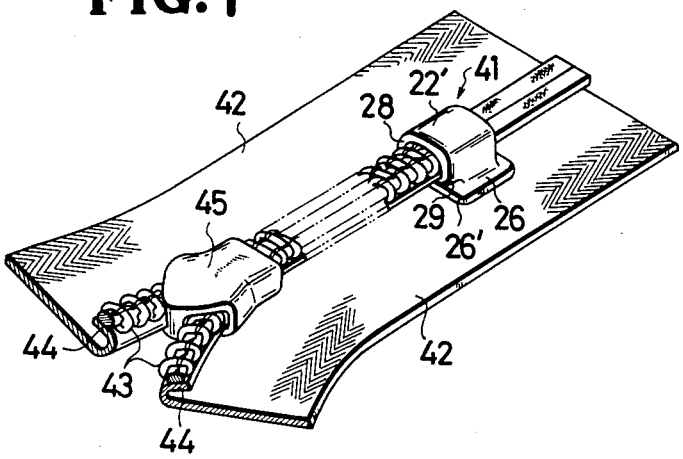
FIG. 7 is a perspective view of a portion of a concealed slide fastener to which a bottom end stop is applied.
Figure 8:
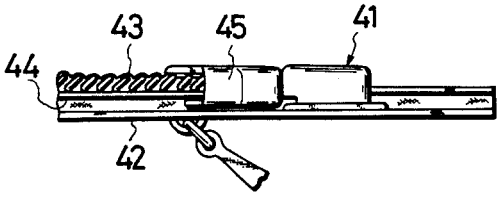
FIG. 8 is a side elevational view of the concealed slide fastener of FIG. 7.
Figure 9:
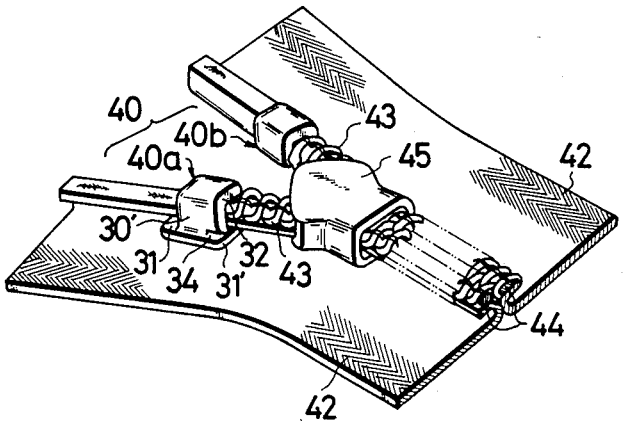
FIG. 9 is a perspective view of a portion of the slide fastener of FIG. 7 to which a top end stop is applied.

A typical example of such concealed slide fasteners is shown in FIGS. 7 through 9. The concealed slide fastener includes top and bottom end stops 40, 41 mounted on a pair of slide fastener stringer tapes 42, 42 adjacent to opposite ends of a pair of rows of continuous coiled coupling elements 43 mounted on and along inner longitudinal edges 44 of the stringer tapes 42, the inner tape edges 44 being folded over themselves. The fastener also includes a slider 45 slidably mounted on the rows of coupling elements 43 and reciprocably movable between the top and bottom end stops 40, 41. The bottom end stop 41 (FIG. 7) is structurally and functionally the same as the bottom end stop 22 shown in FIG. 1 and hence description is not necessary. The top end stop 40 (FIG. 9) is also substantially identical with the top end stop 30 of FIG. 2 with the exception that the top end stop 40 is composed of a pair of end stop halves **40*a*, 40*b*. Structural details of the top and bottom stops 40, 41 are designated by the same reference numerals as those used in FIGS. 1 and 2**.

What is claimed is:

1. A slide fastener comprising:

(a) a pair of slide fastener stringers each having a stringer tape and a row of coupling elements mounted on and along a folded inner longitudinal edge of each stringer tape;

(b) a slider slidably mounted on the two rows of coupling elements to take the latter into and out of coupling engagement with each other to close and open said slide fastener; and (c) an end stop mounted on said stringer tapes adjacent to one end of said rows of coupling elements for limiting movement of said slider, said end stop including a substantially rectangular block attached to a portion of said folded inner longitudinal edges including a plurality of coupling elements, and a flared bottom peripheral seat integral with said block and attached to said stringer tapes, said block having an end wall engageable with said slider and a cut-out recess extending in said end wall and defined by and between said block and a portion of said peripheral seat, said portion of said peripheral seat terminating slightly short of said end wall.

2. A slide fastener according to claim 1, said cut-out recess being formed in and around the entire bottom periphery of said block.

3. A slide fastener according to claim 1, said portion of said folded inner tape edges being engaged with each other and being embedded in said block together with said coupling elements mounted thereon.

4. A slide fastener according to claim 1, said portion of said folded inner tape edges being parallel spaced from one another and being embedded in said block of said end stop together with said coupling elements mounted thereon.

5. A slide fastener according to claim 1, further including a reinforcing backing partly joined to the underside of said stringer tapes, said end stop being mounted partly on said backing and partly on the stringer tapes.

* * * * *